US011796165B2

(12) United States Patent
Flynn et al.

(10) Patent No.: US 11,796,165 B2
(45) Date of Patent: Oct. 24, 2023

(54) TERMINAL FOR A TAPE LIGHT

(71) Applicant: Alloy LED, LLC, Emeryville, CA (US)

(72) Inventors: Joseph Flynn, Oakland, CA (US); Wyanne Tsang, Halifax (CA); Max Darling, Oakland, CA (US)

(73) Assignee: Alloy LED, LLC, Emeryville, CA (US)

( * ) Notice: Subject to any disclaimer, the term of this patent is extended or adjusted under 35 U.S.C. 154(b) by 0 days.

(21) Appl. No.: 17/704,787

(22) Filed: Mar. 25, 2022

(65) Prior Publication Data

US 2022/0349564 A1 Nov. 3, 2022

Related U.S. Application Data

(60) Provisional application No. 63/181,103, filed on Apr. 28, 2021.

(51) Int. Cl.

| | |
|---|---|
| ***F21V 23/06*** | (2006.01) |
| ***F21S 4/24*** | (2016.01) |
| ***F21V 23/00*** | (2015.01) |
| ***H01R 13/00*** | (2006.01) |
| ***H01R 4/32*** | (2006.01) |
| ***F21Y 103/10*** | (2016.01) |
| ***F21Y 115/10*** | (2016.01) |
| ***F21V 21/005*** | (2006.01) |
| ***H01R 11/01*** | (2006.01) |

(52) U.S. Cl.

CPC ..... *F21V 23/06* (2013.01); *F21S 4/24* (2016.01); *F21V 23/001* (2013.01); *H01R 4/32* (2013.01); *H01R 13/00* (2013.01); *F21V 21/005* (2013.01); *F21Y 2103/10* (2016.08); *F21Y 2115/10* (2016.08); *H01R 11/01* (2013.01)

(58) Field of Classification Search

CPC ..... F21S 4/24; F21S 4/22; F21S 4/20; F21V 23/06

See application file for complete search history.

(56) References Cited

U.S. PATENT DOCUMENTS

| | | | | |
|---|---|---|---|---|
| 10,591,114 | B1 * | 3/2020 | Lassen | F21V 15/013 |
| 10,727,621 | B1 * | 7/2020 | Senofsky | H01R 12/79 |
| 10,826,202 | B1 * | 11/2020 | Lowe | H01R 35/04 |
| 11,125,399 | B1 * | 9/2021 | Zarcone | F21V 23/005 |

(Continued)

FOREIGN PATENT DOCUMENTS

| | | | | |
|---|---|---|---|---|
| GB | 2582046 A | * | 9/2020 | H01R 4/36 |

*Primary Examiner* — William N Harris

(74) *Attorney, Agent, or Firm* — Dragon Sun Law Firm, PC; Nathaniel Perkins

(57) ABSTRACT

A terminal to connect of a tape light with at least one electric element is disclosed. The terminal includes a body having a base, a first sidewall extending outwardly from the base and defining an opening to receive a portion of the tape light, a second sidewall extending outwardly from the base and arranged spaced apart from the first sidewall. The second sidewall defines at least one groove extending inside the body from the second sidewall for receiving the at least one electric element. Further, the terminal includes a roof arranged opposite to the base and defining a plurality of cut-outs extending from the roof to the opening and a plurality of holes extending from the roof to the at least one groove, and a plurality of rails extending from the first sidewall to the second sidewall intersecting the plurality of cut-outs and the plurality of holes.

5 Claims, 7 Drawing Sheets

(56) References Cited

U.S. PATENT DOCUMENTS

| | | | | |
|---|---|---|---|---|
| 2015/0241035 | A1* | 8/2015 | Dankelmann | F21V 21/005 439/725 |
| 2015/0303632 | A1* | 10/2015 | Tremaine | H01R 43/20 439/626 |
| 2018/0320874 | A1* | 11/2018 | Nicolai | F21S 4/20 |
| 2020/0132288 | A1* | 4/2020 | Ouyang | F21V 23/023 |
| 2021/0302014 | A1* | 9/2021 | Kalliche | F21S 4/20 |
| 2022/0329026 | A1* | 10/2022 | Shao | H05B 45/48 |

* cited by examiner

TERMINAL FOR A TAPE LIGHT

CROSS-REFERENCE TO RELATED APPLICATION

This application claims priority from U.S. Provisional Application No. 63/181,103 filed Apr. 28, 2021, titled "Terminal for a Tape Light", the content of which is incorporated herein.

BACKGROUND

1. Technical Field

The present disclosure pertains to an electrical terminal More particularly, the present disclosure pertains to an electrical terminal suitable for connecting tape lights of both the RGB type and RGBW type.

2. Description of the Prior Art

Tape lights with a plurality of light-emitting diodes have become increasingly popular in various applications of lightning, such as home decoration and office decoration. Typically, terminal style connectors are used for electrically connecting the tape lights to an electrical source. However, a terminal connector that is used for connecting an RGB type tape light, cannot be used for connecting an RGBW type tape light, because there would not be enough room to accommodate the 5 screws for RGBW tape light. Also, if a terminal connector is used to connect a tape light having a width of 20 mm, the same terminal connector cannot be used for a tape light that is much narrower than 20 mm such as a 10 mm or 14 mm wide tape.

SUMMARY

According to an aspect of the disclosure a terminal for a light system having a tape light is disclosed. The terminal enables a connection of the tape light with at least one electric element. The terminal includes a body having a base, a first sidewall extending outwardly from the base and defining an opening to receive a portion of the tape light, and a second sidewall extending outwardly from the base and arranged spaced apart from the first sidewall. The second sidewall defines at least one groove extending inside the body from the second sidewall for receiving the at least one electric element. In addition, the body includes a roof arranged opposite to the base and defining a plurality of cut-outs arranged proximate to the first sidewall and extending from the roof to the opening, and a plurality of holes arranged proximate to the second sidewall and extending inside the body from the roof to the plurality of grooves. Further, the body includes a plurality of rails arranged inside the body and extending from the first sidewall to the second sidewall intersecting the plurality of cut-outs of the body and the plurality of holes of the body. Each rail includes a first hole arranged proximate to the second sidewall and a second hole arranged proximate to the first sidewall. The axes of the first holes of the rails align with axes of the holes of the body and axes of the second holes of the rails align with axes of the cut-outs of the body.

In some embodiments, the rails are arranged in a plurality of rows and in a staggered arrangement.

In some embodiments, the roof is an arcuate roof, and the plurality of cut-outs is arcuately arrayed between a third sidewall of the body and a fourth sidewall of the body. Also, the plurality of holes is arcuately arrayed along the roof between a third sidewall of the body and a fourth sidewall of the body.

In some embodiments, the plurality of cut-outs is oriented such that the axes of the cut-outs intersect each other. Further, the plurality of holes of the body is oriented such that the axes of the holes of body intersect with each other.

In some embodiments, the terminal further includes a plurality of first screws adapted to extend inside the at least one groove through the plurality of holes of the body and the first holes of the plurality of rails to electrically connect the plurality of rails with the plurality of wires.

In some embodiments, the at least one electric element includes a plurality of wires and at least one groove includes a plurality of grooves, wherein the first screws engage with the plurality of wires arranged inside the plurality of grooves.

In some embodiments, the terminal further includes a plurality of second screws adapted to extend inside the opening through the plurality of cut-outs of the body and the second holes of the plurality of rails to electrically connect the plurality of rails with a plurality of connectors of the tape light.

In some embodiments, the second screws engage with the connectors of the tape light to retain the tape light inside the opening.

According to an aspect of the disclosure a light system is disclosed. The light system includes a tape light having a plurality of light emitting diodes, and a terminal to facilitate an electrical connection of the tape light with at least one electric element. The terminal includes a body having a base, a first sidewall extending outwardly from the base and defining an opening to receive a portion of the tape light, and a second sidewall extending outwardly from the base and arranged spaced apart the first sidewall. The second sidewall defines at least one groove extending inside the body from the second sidewall for receiving the at least one electric element. In addition, the body includes a roof arranged opposite to the base and defining a plurality of cut-outs arranged proximate to the first sidewall and extending from the roof to the opening, and a plurality of holes arranged proximate to the second sidewall and extending inside the body from the roof to the at least one groove. Further, the terminal includes a plurality of rails arranged inside the body between the roof and the base and extending from the first sidewall to the second sidewall intersecting the plurality of cut-outs of the body and the plurality of holes of the body. Each rail includes a first hole arranged proximate to the second sidewall and a second hole arranged proximate to the first sidewall. The axes of the first holes of the rails align with axes of the holes of the body and axes of the second holes of the rails align with axes of the cut-outs of the body.

In some embodiments, the rails are arranged in a plurality of rows and in a staggered arrangement.

In some embodiments, the roof is an arcuate roof, and the plurality of cut-outs is arcuately arrayed between a third sidewall of the body and a fourth sidewall of the body. Also, the plurality of holes is arcuately arrayed along the roof between a third sidewall of the body and a fourth sidewall of the body.

In some embodiments, the plurality of cut-outs is oriented such that the axes of the cut-outs intersect each other. Further, the plurality of holes of the body is oriented such that the axes of the holes of body intersect with each other.

In some embodiments, the light system further includes a plurality of first screws extending inside the at least one groove through the plurality of holes of the body and the first holes of the plurality of rails to electrically connect the plurality of rails with the at least one electric element.

In some embodiments, the at least one electric element includes a plurality of wires and at least one groove includes a plurality of grooves. The first screws engage with the plurality of wires arranged inside the plurality of grooves In some embodiments, the light system further includes a plurality of second screws extending inside the opening through the plurality of cut-outs of the body and the second holes of the plurality of rails inside the openings to electrically connect the plurality of rails with a plurality of connectors of the tape light In some embodiments, the second screws engage with the connectors of the tape light to retain the tape light inside the opening.

A terminal for a light system having a tape light is disclosure, according to yet another aspect of the disclosure. The terminal enables a connection of the tape light with at least one electric element. The terminal includes a body having a base, a first sidewall extending outwardly from the base and defining an opening to receive a portion of the tape light, and a second sidewall extending outwardly from the base and arranged spaced apart from the first sidewall. The second sidewall defines at least one groove extending inside the body from the second sidewall for receiving the at least one electric element. The body also includes a roof arranged opposite to the base. The roof defines a plurality of cut-outs arranged proximate to the first sidewall and extending from the roof to the opening, and a plurality of holes arranged proximate to the second sidewall and extending inside the body from the roof to the at least one groove. The terminal further includes a plurality of rails arranged inside the body in a plurality of rows and extending from the first sidewall to the second sidewall intersecting the plurality of cut-outs of the body and the plurality of holes of the body. Each rail includes a first hole arranged proximate to the second sidewall and a second hole arranged proximate to the first sidewall. Axes of the first holes of the rails align with axes of the holes of the body and axes of the second holes of the rails align with axes of the cut-outs of the body. Also, the plurality of rails is disposed in a staggered arrangement between two consecutive rows.

In some embodiments, the at least one electric element includes a plurality of wires and at least one groove includes a plurality of grooves. The terminal further includes a plurality of first screws adapted to extend inside the plurality of grooves through the plurality of holes of the body and the first holes of the plurality of rails to electrically connect the plurality of rails with the plurality of wires.

In some embodiments, the terminal also includes a plurality of second screws adapted to extend inside the opening through the plurality of cut-outs of the body and the second holes of the plurality of rails to electrically connect the plurality of rails with a plurality of connectors of the tape light.

THE LIST OF REFERENCES

Figure 1:
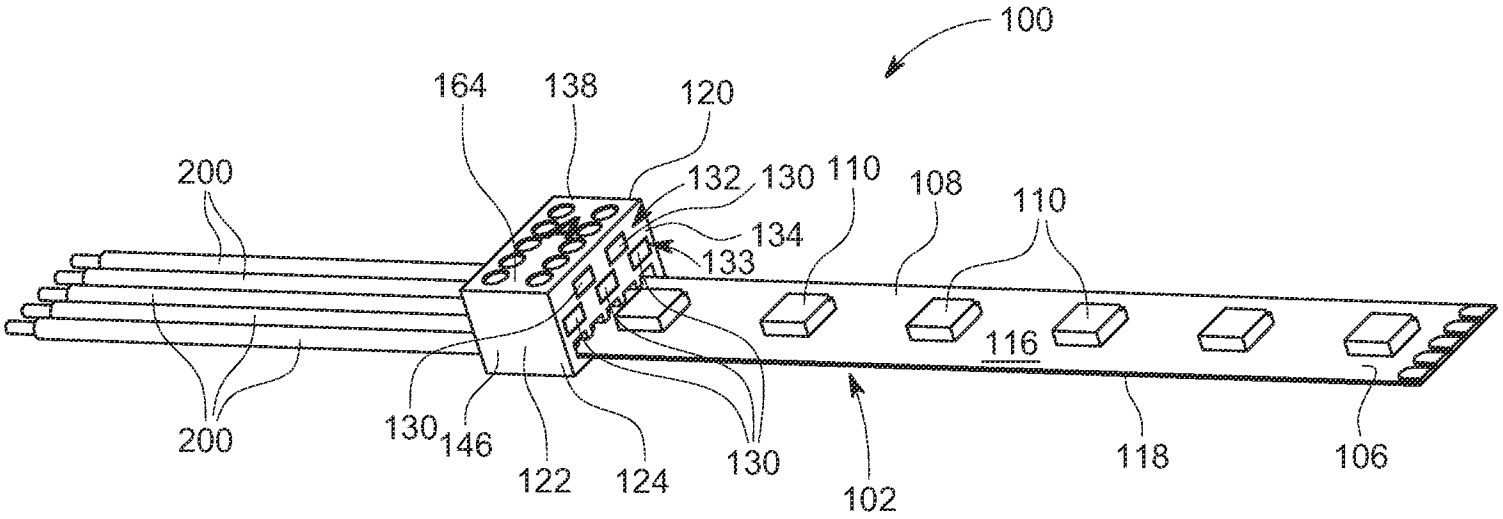
FIG. 1 illustrates a light system having a tape light and a terminal connected to the tape light, in accordance with an embodiment of the disclosure.

100 light system, 100' light system, 102 tape light, 104 first longitudinal end
106 second longitudinal end, 108 strip, 110 LED, 112 connector,
116 first surface, 118 second surface, 120, electrical terminal, 120' electrical terminal,
122 housing, 122' housing, 124 body, 124' body, 130 rail, 134 first sidewall,
136 second sidewall, 138 roof, 138' roof 140 base, 144 opening, 146 third sidewall,
148 fourth sidewall, 150 grooves, 150*a* first groove, 150*b* second groove, 150*c* third groove,
150*d* fourth groove, 150*e* fifth groove, 154 slots, 154' slots, 154*a* first slot, 154*b* second slot,
154*c* third slot, 154*d* fourth slot, 154*e* fifth slot, 156 partition wall, 160 separation wall,
162 holes, 162' holes, 162*a* first hole, 162*b* second hole, 162*c* third hole, 162*d* fourth hole,
162*e* fifth hole, 164 upper surface, 166 first hole portion, 168 lower surface,
170 second hole portion, 172 upper surface, 174 lower surface, 180 cut-outs, 180' cut-outs,
180*a* first cut-out, 180*b* second cut-out, 180*c* third cut-out, 180*d* fourth cut-out,
180*e* fifth cut-out, 182, first cut-out portion, 184 second cut-out portion,
186 first hole, 188 second hole, 200 wires, 202 first screws, 204 second screws.

DETAILED DESCRIPTION

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Figure 2:
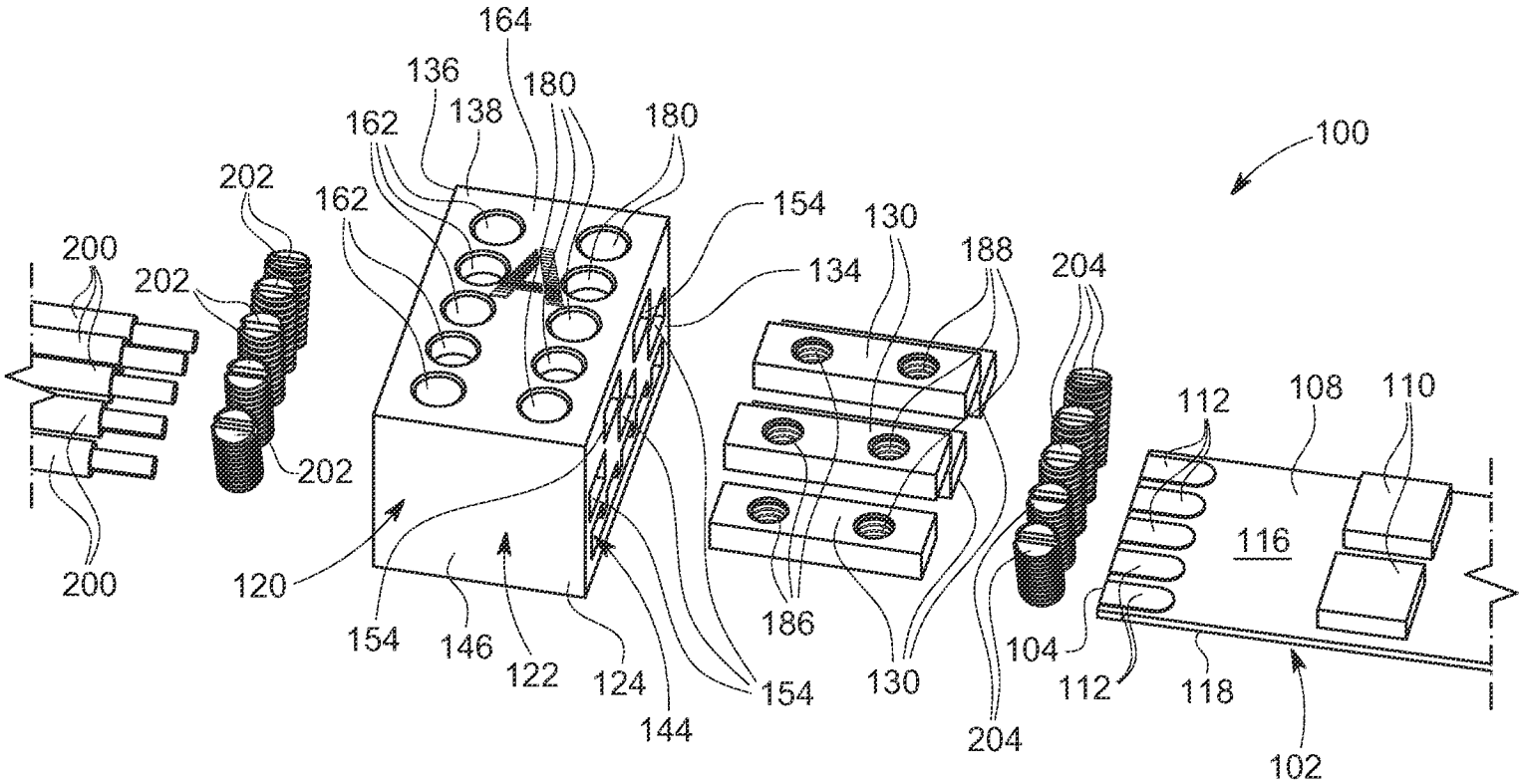
FIG. 2 illustrates an exploded view of the light system, in accordance with an embodiment of the disclosure.
Figure 3:
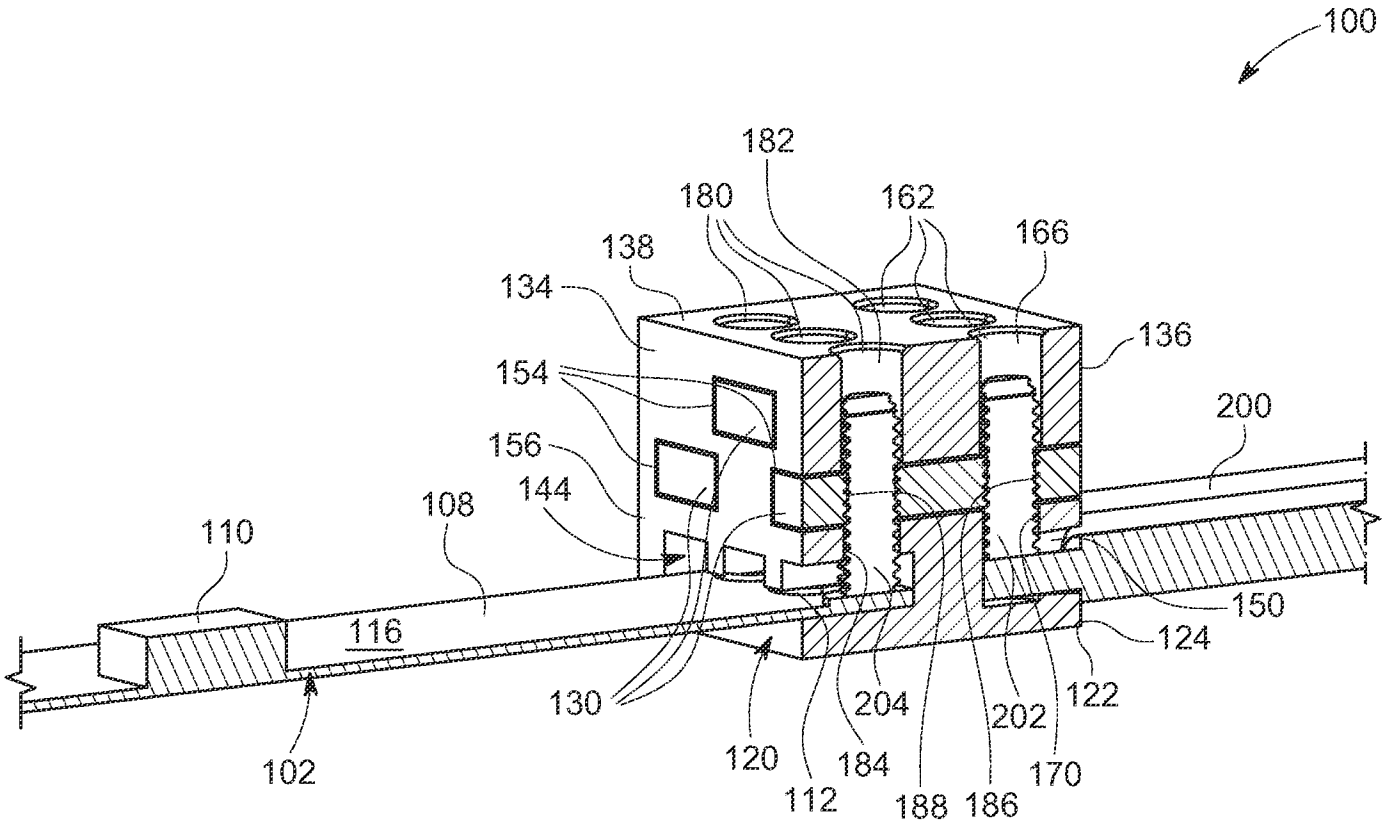
FIG. 3 illustrates a sectional perspective view of the light system, in accordance with an embodiment of the disclosure.

Referring to FIG. 1 to FIG. 3, a light system 100 is shown. The light system 100 includes a tape light 102 having a first longitudinal end 104 (shown in FIG. 2) and a second longitudinal end 106, a strip 108 extending from the first longitudinal end 104 to the second longitudinal end 106, and a plurality of light-emitting diodes (LEDs) 110 connected to the strip 108 and arranged between the first longitudinal end 104 and the second longitudinal end 106. The tape light 102 further includes a plurality of connectors 112 (best shown in FIG. 2) disposed at the first longitudinal end 104 and adapted to facilitate an electric connection of the LEDs 110 with an electric source (not shown).

The strip 108 facilitates the positioning of the tape light 102 on any surface/boundary. For example, the strip 108 facilitates the positioning of the tape light 102 on any curved surface. In an embodiment, the strip 108 includes a first surface 116 and a second surface 118 disposed opposite to the first surface 116. As shown, the plurality of LEDs 110 is attached to the first surface 116, while the second surface 118 may include an adhesive surface to adhesively attach the tape light 102 to a surface. In an embodiment, the strip 108 may include a cover (not shown) removably attached to the second surface 118 of the strip 108. The cover may be removed or peeled off from the second surface 118 prior to attaching the tape light 102 (i.e., the strip 108) to any object or surface.

In the embodiment, the tape light 102 is a RGBW (RED Green BLUE White) tape light having five connectors 112 adapted to be electrically connected to the electrical source. In another embodiment, the tape light is a RGB (Red Green and Blue) tape light 102 having four connectors 112 adapted to be electrically connected to the electrical source. It may be appreciated that the connectors 112 are made of any electrically conducting material, such as, but not limited to, copper, aluminum, or any suitable metal or alloy that facilitates the conduction of electricity from the electric source to the LEDs 110. To facilitate the connection of the connectors 112 with the electric source, the light system 100 includes an electrical terminal 120 (hereinafter referred to as the terminal 120 and a plurality of wires 200 (i.e., electric elements 200) electrically connecting the electrical source to the terminal 120.

Referring to FIGS. 1 to 5, the terminal 120 includes a housing 122 having a body 124 and a plurality of rails 130, for example, five rails, arranged inside the housing 122 in plurality of rows, for example, a first row 132 and a second row 133. As shown, the rails 130, in the two rows 132, 133, are disposed in a staggered manner/arrangement. The plurality of rails 130 facilitates the electrical connection of the plurality of wires 200 with the plurality of connectors 112. As shown, the housing 122 may include a cuboidal structure with the body 124 having a first sidewall 134, a second sidewall 136 disposed opposite to the first sidewall 134, a roof 138, and a base 140 disposed of opposite to the roof 138. The first sidewall 134 defines an opening 144 that extends from the first sidewall 134 towards the second sidewall 136. The opening 144 facilitates an insertion of the tape light 102 inside the housing 122. In an embodiment, the opening 144 may be a rectangular slot and may be disposed proximate to the base 140 of the housing 122.

Figure 4:
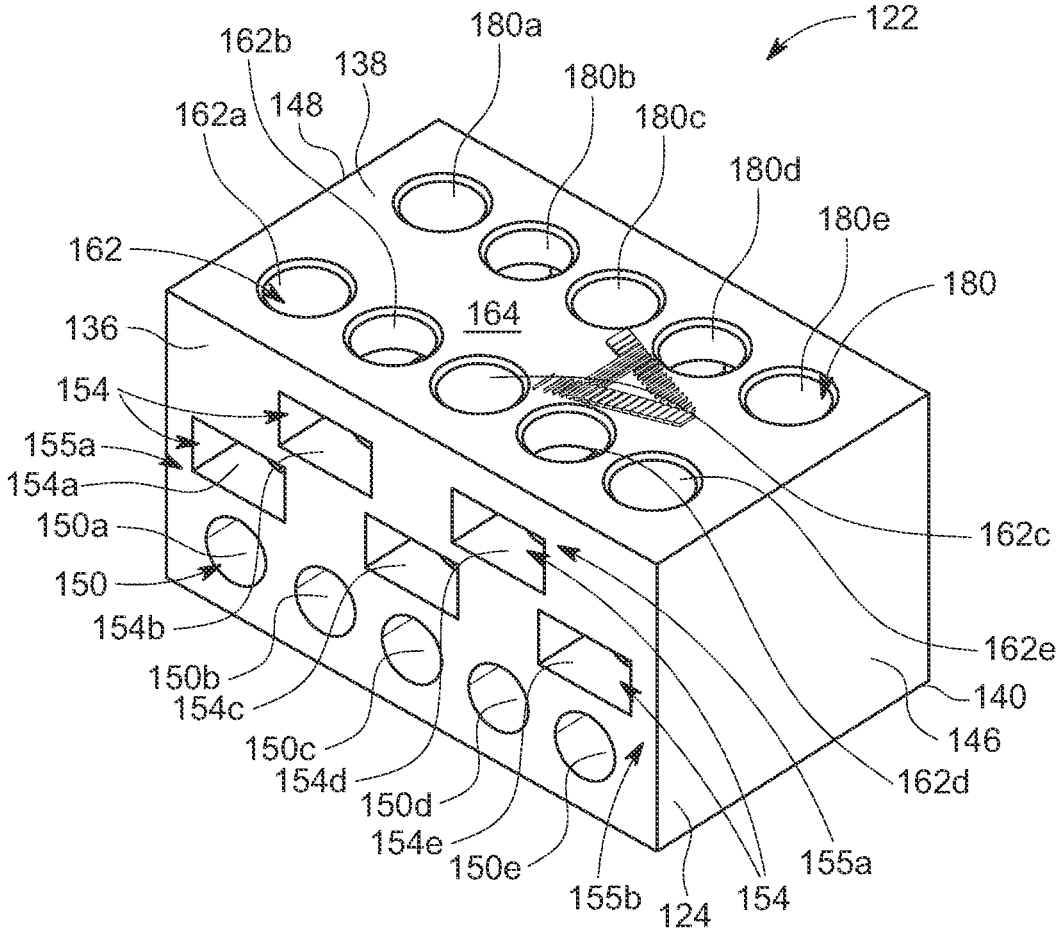
FIG. 4 illustrates a top perspective view of a terminal of the light system, in accordance with an embodiment of the disclosure.
Figure 5:
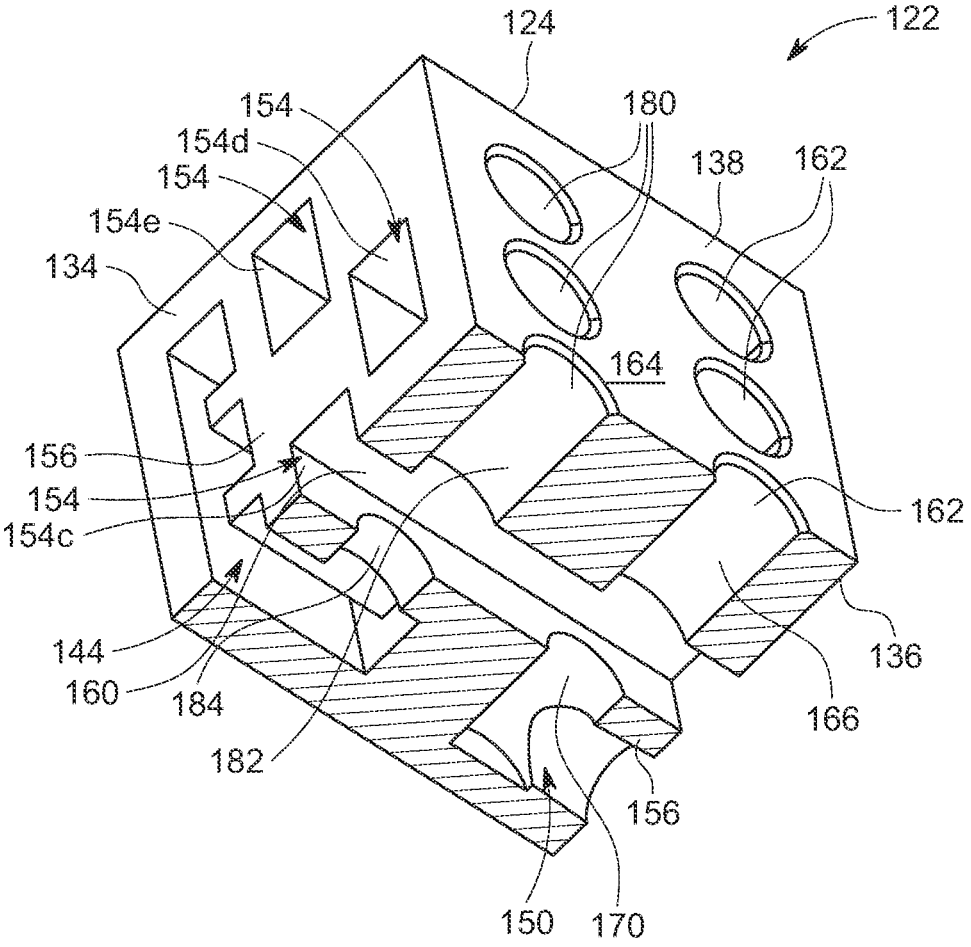
FIG. 5 illustrates a sectional perspective view of the terminal of the light system, in accordance with an embodiment of the disclosure.

Further, as best shown in FIG. 4, the second sidewall 136 defines at least one groove, for example, a plurality of grooves 150, for example, a first groove 150*a*, a second groove 150*b*, a third groove 150*c*, a fourth groove 150*d*, and a fifth groove 150*e*, arranged spaced apart from each other and extending from the second sidewall 136 towards the first sidewall 134. The grooves 150 are arrayed along a width of the second sidewall 136 between a third sidewall 146 and a fourth sidewall 148. Each of the grooves 150 facilitates insertion of one of the plurality of wires 200 inside the housing 122 to enable the electrical connection of the wires 200 with the plurality of rails 130. In the embodiment, the plurality of grooves 150 is arranged proximate to the base 140 of the housing 122.

Further, as shown, the body 124 defines a plurality of slots 154, for example, a first slot 154*a*, a second slot 154*b*, a third slot 154*c*, a fourth slot 154*d*, and a fifth slot 154*e*, extending from the first sidewall 134 to the second sidewall 136, and arrayed between the third sidewall 146 and the fourth sidewall 148. As shown, the plurality of slots 154 is arranged in a staggered arrangement in a plurality of rows, for example, a first row 155*a* and a second row 155*b*. The first row 155*a* includes two slots, for example, the second slot 154*b* and the fourth slot 154*d*, while the second row 155*b* include three slots, for example, the first slot 154*a*, the third slot 154*c*, and the fifth slot 154*e*. The first row 155*a* is arranged proximate to the roof 138, while the second row 155*b* is arranged between the first row 155*a* and the grooves 150. Accordingly, a horizontally oriented partition wall 156 is defined between the roof 138 and the base 140. The partition wall 156 extends from the first sidewall 134 to the second sidewall 136, and separates the opening 144 from the slots 154, and separates the slots 154 from the grooves 150. Moreover, each slot 154 is separated from an adjacent slot by a vertically oriented separation wall 160 to enables an electrical insulation/isolation of one rail 130 from an adjacent rail 130. The plurality of slots 154 are adapted to house the plurality of rails 130.

Moreover, the body 124 may define a plurality of holes 162 extending from an upper surface 164 of the roof 138 through the body 124 and intersecting the plurality of grooves 150. As shown, the roof 138 is a flat wall having the flat upper surface 164 and the holes 162 are arrayed in a single row between the third sidewall 146 and the fourth sidewall 148. The holes 162 are oriented inside the body 124 such that each hole 162 extends inwardly inside the body 124 from the upper surface 164 of the roof 138. Accordingly, the holes 162 are arranged or oriented such that the axes of the holes 162 are substantially parallel to each other. Further, as shown, each hole 162 includes a first hole portion 166 extending from the upper surface 164 of the roof 138 to an associated slot 154 arranged directly below the hole 162 and a second hole portion 170 extending from the associated slot 154 to the groove 150 arranged directly underneath the hole 160 and through the partition wall 156. Further, as shown, the plurality of holes 162 is arranged proximate to the second sidewall 136 and intersects the plurality of slots 154. For example, a first hole 162*a*, a second hole 162*b*, a third hole 162*c*, a fourth hole 162*d*, and a fifth hole 162*e*, respectively intersects the first slot 154*a*, the second slot 154*b*, the third slot 154*c*, the fourth slot 154*d*, and the fifth slot 154*e*. In an embodiment, a plurality of first screws 202 extends inside the body 124 through the plurality of rails 130 to securely engage the plurality of the wires 200 within the housing 122 and electrically connect the plurality of rails 130 to the plurality of wires 200. It may be appreciated that the first screws 202 may be loosened to remove the wires 200 from the housing 122.

Further, the body 124 may define a plurality of cut-outs 180 arranged proximate to the first sidewall 134 and extending from the upper surface 164 of the roof 138 through the body 124 and intersecting with the opening 144. Similar to the holes 162, the cut-outs 180 are arrayed linearly between the third sidewall 146 and the fourth sidewall 148, and are oriented inside the body 124 such that each cut-out 180 extends inwardly, inside the body 124, from the upper surface 164 of the roof 138. Accordingly, the cut-outs 180 are arranged or oriented such that axes of the cut-outs 180 are substantially parallel to each other. Further, as shown, each cut-out 180 includes a first cut-out portion 182 extending from the upper surface 164 of the roof 128 to the slot 154 arranged directly below the cut-out 180, and a second cut-out portion 184 extending from the associated slot 154 to the opening 144 through the partition wall 156. The plurality of cut-outs 180 also intersects the plurality of slots 154. For example, a first cut-out 180*a*, a second cut-out 180*b*, a third cut-out 180*c*, a fourth cut-out 180*d*, and a fifth cut-out 180*c*, respectively intersects the first slot 154*a*, the second slot 154*b*, the third slot 154*c*, the fourth slot 154*d*, and the fifth slot 154*d*. In an embodiment, a plurality of second screws 204 extends inside the body 124 through the cut-outs 180 and the plurality of rails 130 to securely engage the tape light 102 within the housing 122 and contact the plurality of connectors 112 to electrically connect the plurality of rails 130 to the plurality of connectors 112. It may be appreciated that the second screws 204 may be loosened to remove the tape light 102 from the housing 122.

Referring to FIGS. 1 to 3, the plurality of rails 130, for example, five rails, is arranged inside the plurality of slots 154 of the housing 122 such that relative orientation of the rails 130 remains fixed within the housing 122. As shown in FIG. 3, each rail 130 is arranged inside an associated slot 154 such that a first hole 186 of the rail 130 is aligned with a corresponding hole 162 (i.e., the first hole portion 166 and the second hole portion 170) intersecting the associated slot 154. Similarly, each rail 130 is arranged inside an associated slot 154 such that a second hole 188 of the rail 130 is aligned with the cut-out 180 (i.e., the first cut-out portion 182 and the second cut-out portion 184) intersecting the associated slot 154. Accordingly, the first screws 202 extend through the first holes 186 of the rails 130 and contact the wires 200 to securely engage the wires 200 inside the housing 122, thereby electrically connecting the wires 200 with the rails 130. Also, the second screws 204 extend through the second holes 188 of the rails 130 and contact the connectors 112 to securely engage the tape light 102 inside the housing 122, thereby electrically connecting the connectors 112 with the rails 130. It may be appreciated that each rail 130 is made of an electrically conducting material, such as but not limited to, copper, silver, aluminum, or any other suitable material facilitating a flow of electricity from the wires 200 to the LED 110.

Figure 6:
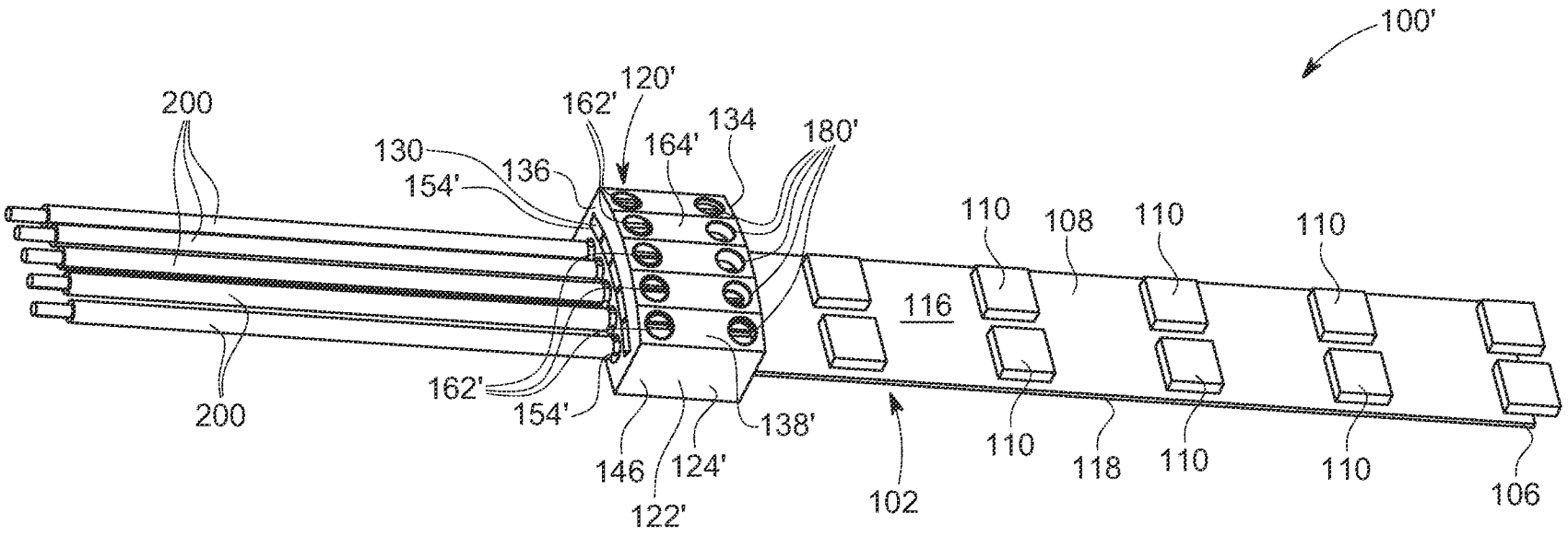
FIG. 6 illustrates a light system having a tape light and a terminal connected to the tape light, in accordance with an alternative embodiment of the disclosure.

Referring to FIG. 6, a light system 100' is shown according to an alternative embodiment of the present disclosure. The light system 100' is similar to the light system 100 except an electrical terminal 120' is different from the terminal 120 in the aspect that a roof 138' of a body 124' of a housing 122' of the terminal 120' is an arcuate wall having and arcuate upper surface 164', and a plurality of slots 154' are similar to the plurality of slots 154 except that plurality of slots 154' are arranged in single row. Further, the body 124' defines a plurality of holes 162' that are similar to the plurality of holes 162 except that the holes are arranged or oriented such that central axes of the holes 162' intersect each other. In an embodiment, the holes 162' are oriented such that the central axes of holes 162' meet at a common point that may be a center of an arc defined by the arcuate upper surface 164' of the roof 138. Also, the body 124' defines a plurality of cut-outs 180' that are similar to the plurality of cut-outs 180 except that the cut-outs 180' are arranged or oriented such that central axes of the cut-out 180' intersect each other. In an embodiment, the cut-outs 180' are oriented such that the central axes of the cut-outs 180' meet at a common point that may be a center of an arc defined by the arcuate upper surface 164' of the roof 138. For facilitating the lightening of the tape light 102, the tape light 102 is connected to the terminal 120. For so doing, the first longitudinal end 104 is inserted inside the opening 144 of the first sidewall 134, such that the five connectors 112 are directly below the plurality of cut-outs 180. Thereafter, the second screws 204 are inserted inside the housing 122 through the cut-outs 180, 180' and tightened. In so doing, the second screws 204 extend through the first cut-out portions 182, the second holes 188, and the second cut-out portions 184 and abut the connectors 112 of the tape light 102.

For connecting the terminal 120, 120' with an electrical source, each of the wires 200 is inserted inside an associated groove 150 and secured inside the housing 120, 120' via the first screws 202. For so doing, the first screws 202 are inserted through the holes 162, 162' and tightened. In so doing, the first screws 202 extend through the first hole portions 166, the first holes 186, and the second hole portions 170 and abuts the wires 200. Accordingly, the first screws 202 contact the wires 200 via the plurality of rails 130, thereby enabling the electrical connection of the plurality of rails 130 with the plurality of wires 200.

Figure 7:
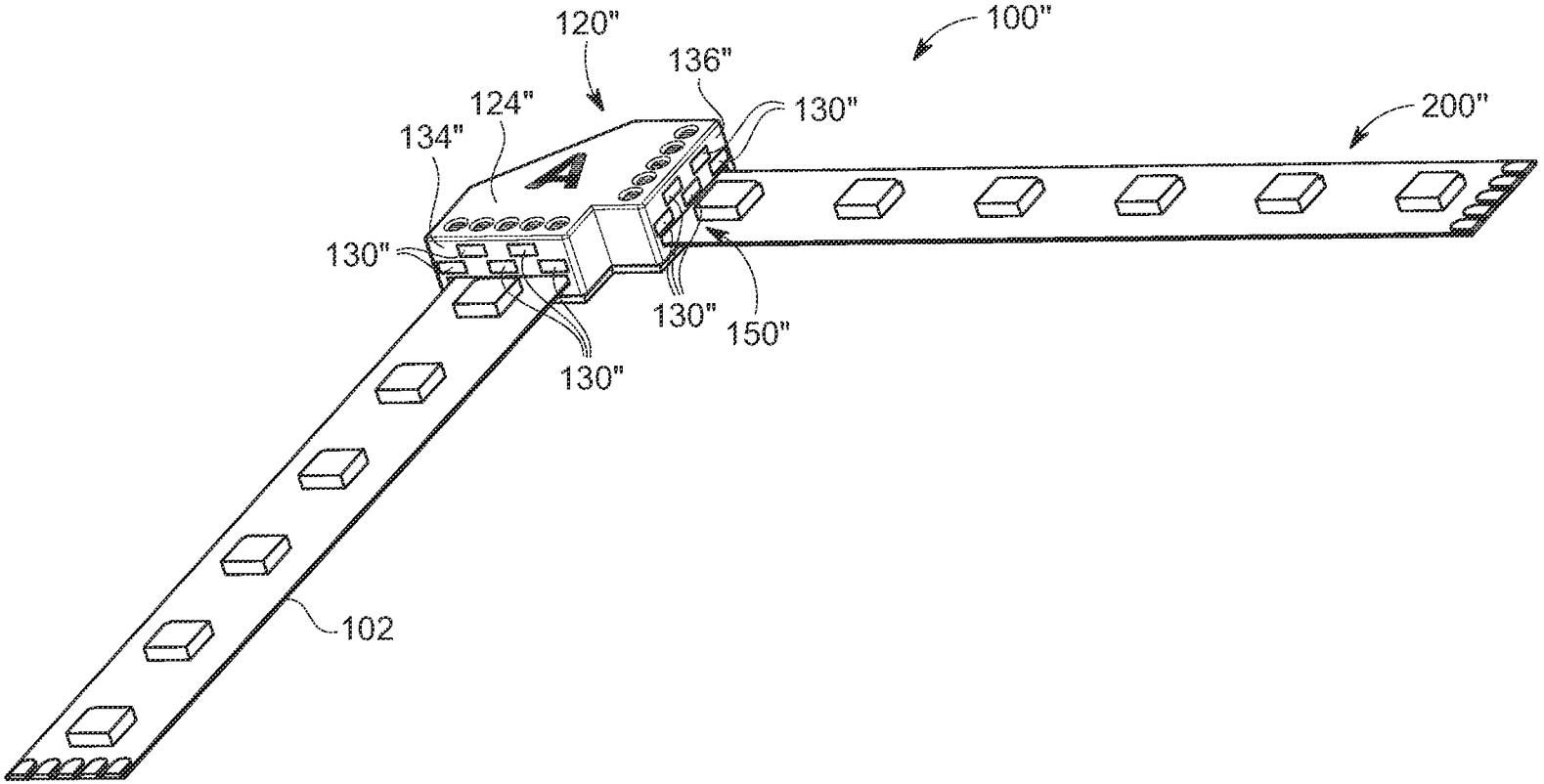
FIG. 7 illustrates a light system having a terminal connecting two tape lights, in accordance with an alternative embodiment of the disclosure.

In some embodiments, referring to FIG. 7, a light system 100" is shown according to an alternative embodiment of the present disclosure. The light system 100" is similar to the light system 100 except an electrical terminal 120" is different from the terminal 120. As shown the electric terminal 120" includes a body 124" having a substantially L shape and is adapted to enable a connection the tape light 102 to a second tape light 200" (i.e., electric element). Accordingly, a first sidewall 134" and a second sidewall 136" are arranged at the ends of the body 124". Moreover, to receive the second tape light 200", the second sidewall 136" defines a single groove 150". Also, each of a plurality of rails 130" of the electric terminal include a substantially bent shape, for example, an L-shape and extends from the first sidewall 134" to the second sidewall 136".

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended specification.

What is claimed is:

1. A terminal for a light system having a tape light, the terminal enables a connection of the tape light with at least one electric element, the terminal comprising:

a body having a base, a first sidewall extending outwardly from the base and defining an opening to receive a portion of the tape light, a second sidewall extending outwardly from the base and arranged spaced apart from the first sidewall, wherein the first sidewall defines an opening that extends from the first sidewall towards the second sidewall; the opening facilitates an insertion of the tape light inside the housing, and the opening comprises a rectangular slot and is disposed proximate to the base of the housing; wherein the opening is configured for insertion of an RGB tape light and an RGBW tape light, the second sidewall defines five grooves extending inside the body from the second sidewall for receiving the at least one electric element and five slots extending from the first sidewall to the second sidewall, and arrayed between a third sidewall and a fourth sidewall, wherein the grooves are arrayed along a width of the second sidewall between the third sidewall and the fourth sidewall; and the plurality of slots is arranged in a staggered arrangement in a first row comprising two slots and a second row comprising three slots, and each of the five slots comprises a rectangular slot having greater height than width, and a roof comprising an upper surface and arranged opposite to the base and defining a plurality of cut-outs arranged proximate to the first sidewall and extending from the roof to the opening, wherein each cut-out comprises a first cut-out portion extending from the upper surface of the roof to the slot arranged directly below the cut-out, and a second cut-out portion extending from the associated slot to the opening through the partition wall; and a plurality of holes extending from the upper surface of the roof through the body and intersecting the plurality of grooves and arranged proximate to the second sidewall and extending inside the body from the roof to the at least one groove, wherein the plurality of holes is arrayed in a single row between the third sidewall and the fourth sidewall, and each hole comprises a first hole portion extending from the upper surface of the roof to an associated slot arranged directly below the hole and a second hole portion extending from the associated slot to the groove arranged directly underneath the hole and through the partition wall; and a plurality of rails arranged inside the body and extending from the first sidewall to the second sidewall intersecting the plurality of cut-outs of the body and the plurality of holes of the body, each rail includes a first hole arranged proximate to the second sidewall and a second hole arranged proximate to the first sidewall, wherein axes of the first holes of the rails align with axes of the holes of the body and axes of the second holes of the rails align with axes of the cut-outs of the body, each first hole of each rail extends from an upper surface of the rail to a lower surface of the rail, and each second hole of each rail extends from the upper surface of the rail to a lower surface of the rail, wherein the rails are arranged in a plurality of rows and in a staggered arrangement;

each of the grooves facilitates insertion of one of the plurality of wires inside the housing to enable the electrical connection of the wires with the plurality of rails; and the plurality of grooves is arranged between the five slots and the base of the housing.

2. The terminal of claim 1 further including a plurality of first screws adapted to extend inside the at least one groove through the plurality of holes of the body and the first holes of the plurality of rails to electrically connect the plurality of rails with the at least one electric element.

3. The terminal of claim 1, wherein the at least one electric element includes a plurality of wires and at least one groove includes a plurality of grooves, wherein the first screws engage with the plurality of wires arranged inside the plurality of grooves.

4. The terminal of claim 1 further including a plurality of second screws adapted to extend inside the opening through the plurality of cut-outs of the body and the second holes of the plurality of rails to electrically connect the plurality of rails with a plurality of connectors of the tape light.

5. The terminal of claim 4, wherein the second screws engage with the connectors of the tape light to retain the tape light inside the opening.

* * * * *